US008938824B2

(12) United States Patent
Rensink et al.

(10) Patent No.: US 8,938,824 B2
(45) Date of Patent: Jan. 27, 2015

(54) MATTRESS COVER

(71) Applicant: Denver Mattress Co., LLC, Denver, CO (US)

(72) Inventors: Bob Rensink, Denver, CO (US); Jonny Amendola, Denver, CO (US)

(73) Assignee: Denver Mattress Co., LLC, Denver, CO (US)

( * ) Notice: Subject to any disclaimer, the term of this patent is extended or adjusted under 35 U.S.C. 154(b) by 46 days.

(21) Appl. No.: 13/658,232

(22) Filed: Oct. 23, 2012

(65) Prior Publication Data

US 2013/0117935 A1 May 16, 2013

Related U.S. Application Data

(60) Provisional application No. 61/592,228, filed on Jan. 30, 2012, provisional application No. 61/558,360, filed on Nov. 10, 2011.

(51) Int. Cl.
*A47C 31/00* (2006.01)
*A47C 31/10* (2006.01)

(52) U.S. Cl.
CPC ..... *A47C 31/007* (2013.01); *A47C 31/105* (2013.01)
USPC ..... 5/499; 5/699; 5/482; 5/496

(58) Field of Classification Search
CPC .... A47C 31/105; A47C 21/06; A47C 27/005; A47C 27/008; A47G 9/0246
USPC ..... 5/499, 699, 496, 482, 484, 738, 739; 24/389, 432, 434–436
See application file for complete search history.

(56) References Cited

U.S. PATENT DOCUMENTS

| | | | | |
|---|---|---|---|---|
| 3,292,748 | A * | 12/1966 | Rifkin | 190/119 |
| 3,879,865 | A * | 4/1975 | Kimball | 36/7.3 |
| 4,397,378 | A * | 8/1983 | Lee | 190/119 |
| 5,159,719 | A * | 11/1992 | Aumann | 2/87 |
| 6,571,432 | B1 * | 6/2003 | Rindle | 24/432 |
| 8,413,276 | B2 * | 4/2013 | Rattner et al. | 5/699 |
| 8,516,633 | B2 * | 8/2013 | Dobin | 5/499 |
| 8,528,134 | B2 * | 9/2013 | Bell et al. | 5/499 |
| 8,615,826 | B2 * | 12/2013 | Michael | 5/482 |
| 2005/0183247 | A1 * | 8/2005 | Berns | 24/432 |
| 2006/0010660 | A1 * | 1/2006 | Stenhall | 24/389 |
| 2008/0040837 | A1 * | 2/2008 | King et al. | 2/227 |
| 2008/0305134 | A1 * | 12/2008 | Lucas | 424/403 |
| 2011/0162140 | A1 * | 7/2011 | Paris | 5/499 |
| 2012/0102646 | A1 * | 5/2012 | Chen et al. | 5/499 |
| 2013/0255041 | A1 * | 10/2013 | Weinstein | 24/387 |

* cited by examiner

*Primary Examiner* — Michael Trettel
*Assistant Examiner* — Myles Throop
(74) *Attorney, Agent, or Firm* — Kilpatrick Townsend & Stockton LLP

(57) ABSTRACT

Embodiments of the invention provide covers for bed components, such as mattresses and/or box-springs, which limit bed bug access to the bed component. According to one embodiment, a cover for a bed component may include an opening that provides access to an interior of the cover and through which a bed component (e.g., a mattress or box-spring) may be inserted, a zipper coupled along the opening, a zipper mechanism slidable along the zipper to couple opposing teeth of the zipper to allow the opening to be zipped closed to enclose the bed component within the cover, a first flap foldable and securable over a distal end of the zipper, a second flap foldable and securable over the first flap, and a barrier material disposed between the second flap and the zipper for applying pressure to the zipper to minimize a gap between the zipper and the first flap.

17 Claims, 16 Drawing Sheets

MATTRESS COVER

CROSS-REFERENCES TO RELATED APPLICATIONS

This application claims priority to U.S. Provisional Patent Application No. 61/592,228 filed Jan. 30, 2012, entitled "Mattress Cover," and U.S. Provisional Patent Application No. 61/558,360 filed Nov. 10, 2011, entitled "Mattress Cover." The entire disclosures of which are hereby incorporated by reference, for all purposes, as if fully set forth herein.

BACKGROUND OF THE INVENTION

Bed bugs are small parasitic insects that may live in or around a bed and that feed on the blood of unsuspecting sleeping victims. Bed bugs may live in hotel rooms, rooms of cruise ships or resorts, or other areas that may be frequented by humans. Unfortunately, bed bugs are often transferred from one area to another by "hitchhiking" on individual's clothing, within luggage, on pets or other objects, through ductwork or false ceilings, and the like. Due to the amount of travel within the United States and Worldwide, bed bugs are becoming an increasingly common problem. Due the increasing occurrence of bed bugs, effective means for dealing with this problem are needed.

BRIEF SUMMARY OF THE INVENTION

Embodiments, of the invention describe mattress covers that may be used to cover a bed component, such as a mattress or box-spring, to discourage bed bugs from accessing a bed component enclosed or encased within the mattress. According to one aspect, a covering for a mattress or box-spring is provided. The covering may include a cover that has an opening that provides access to an interior of the cover. The opening allows a mattress or box-spring to be inserted within the interior of the cover. A zipper may be coupled along the opening, such as by coupling zipper tracks on opposing sides of the opening. A zipper mechanism may be slidable along the zipper to couple opposing teeth of the zipper tracks to allow the opening to be zipped closed to encase or enclose the mattress or box-spring within the cover. A first flap may be folded over a distal end of the zipper to cover the zipper mechanism when the opening is zipped closed and a first fastener may be configured to releasably secure the first flap over the distal end of the zipper. Similarly, a second flap may be folded over the first flap to cover the first flap and a second fastener may be configured to releasably secure the second flap over the first flap. A barrier material, such as a foam or fabric pad, may be disposed between the second flap and the zipper for applying pressure to the zipper to minimize a gap between the zipper and the first flap.

In one embodiment, the barrier material may be coupled with the first flap so that when the first flap is secured over the distal end of the zipper, pressure is applied to the zipper. An additional barrier material, such as an additional foam or fabric pad, maybe coupled with the second flap so that both the first flap and the second flap include barrier materials that apply pressure to the zipper. Alternatively, the barrier material may be coupled with the second flap so that when the second flap is secured over the first flap, pressure is applied to the zipper via the first flap.

In one embodiment, the first flap may fold laterally over the distal end of the zipper in a first direction and the second flap may fold laterally over the first flap in a second direction that is opposite the first direction. The cover may also include a third flap that folds longitudinally over the first and second flaps in a third direction substantially orthogonal to the first and second directions. Alternatively, the first flap may fold over the distal end of the zipper in a first direction and the second flap may fold over the first flap in a second direction that is substantially orthogonal to the first direction. The second direction may be substantially aligned with the zipper.

The second fastener may releasably secure at least two edges of the second flap, and preferably three edges, to the cover and at least one edge of the second flap may be non-releasably secured to the cover (e.g., stitched to the cover) so that when secured to the cover, access underneath the coupled second flap is substantially blocked. Put another way, the outer periphery of the second flap may be effectively sealed via the second fastener to prevent bed bug access to the coupled second flap's interior. In some embodiment, a third fastener may be configured to releasably secure the second flap over the first flap so as to reinforce the coupling of the second flap. The cover may also include stitching that extends laterally across the zipper near a distal end of the zipper to limit distal advancement of the zipper mechanism along the zipper. The barrier material may also include an insect repellant additive to further discourage bed bug access to the enclosed or encased mattress or box-spring.

According to another aspect, a mattress or box-spring encasement is provided. The encasement may include a cover that has an opening to allow a mattress or box-spring to be inserted within an interior of the cover, a zipper coupled with the opening, a zipper mechanism slidable along the zipper to couple opposing teeth of the zipper to allow the opening to be zipped closed to enclose or encase the mattress or box-spring within the cover, a flap foldable and securable over a distal end of the zipper to cover the zipper mechanism when the opening is zipped closed, and a barrier material coupled with the flap so that when the flap is secured over the distal end of the zipper, pressure is applied to the zipper.

The encasement may further include an additional flap that is foldable and securable over the previously described flap (i.e., a first flap). An additional barrier material may be coupled with the additional flap so that when the additional flap is secured over the flap, pressure is applied to the flap.

According to another aspect, a method for covering a mattress or box-spring is provided. The method may include providing a mattress cover that includes: an opening that allows the mattress or box-spring to be inserted within an interior of the cover, a zipper coupled with the opening, a zipper mechanism slidable along the zipper to couple opposing teeth of the zipper to allow the opening to be zipped closed, a first flap foldable and releasably securable over a distal end of the zipper to cover the zipper mechanism when the opening is zipped closed, and a barrier material coupled with the first flap for applying pressure to the zipper when the first flap is secured over the distal end of the zipper. The method may also include inserting the mattress or box-spring within the opening of the mattress cover and advancing the zipper mechanism distally along the zipper to zip the opening closed. The method may further include folding and securing the first flap over the distal end of the zipper to apply pressure to the zipper.

In some embodiments, the method may additionally include folding and securing a second flap over the first flap to cover the first flap. The first flap may be foldable laterally over the distal end of the zipper and the second flap may be foldable longitudinally along the zipper. In some embodiments, three edges of the second flap may be secured to the cover so that the outer periphery of the second flap is substantially secured to the cover. The zipper mechanism may be distally advanced along the zipper until a distal end of the zipper mechanism contacts a distal stop that limits distal advancement of the zipper mechanism. In some embodiments, the distal stop may include stitching positioned laterally across the zipper.

BRIEF DESCRIPTION OF THE DRAWINGS

The present invention is described in conjunction with the appended figures.

Figure 1:
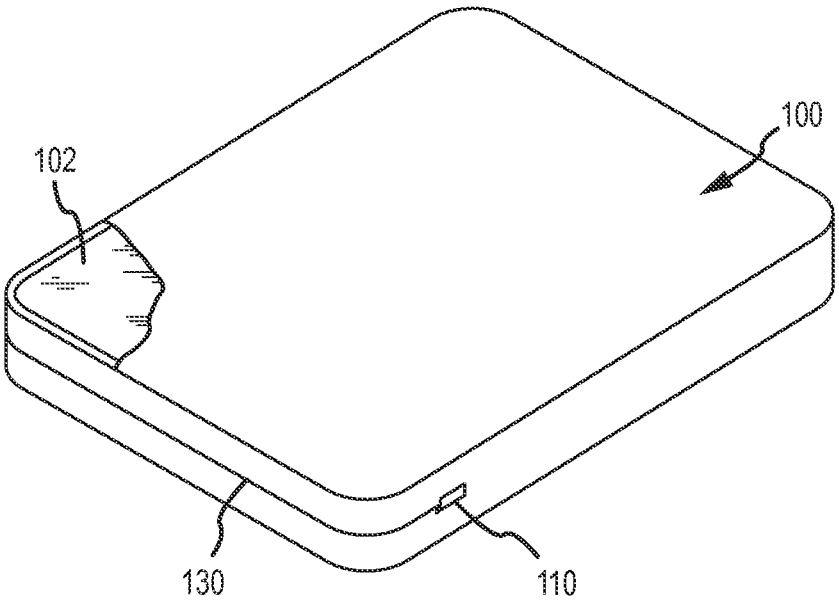
FIG. 1 illustrates a cover encasing a mattress according to an embodiment of the invention.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Embodiments of the invention provide various covers that may be placed over a bed component, such as a mattress or box-spring, to encase or enclose the bed component within there within. For convenience, the bed component will be generally described hereinafter as a mattress although it should be realized that the described covers could be used for other bed components, such as box-springs, bedsprings, bed bases, and the like.

The cover may be configured to limit access to an encased or enclosed mattress. For example, gap spaces or voids through the cover, and especially those around a zipper, may be minimized so that access to the cover's interior and an encased or enclosed mattress is minimized. Such configuration may deter or prevent bed bugs or other undesirable insects from accessing the mattress.

In one embodiment, the cover may include one or more flaps located near or adjacent a zipper end that folds and secures over the zipper to cover the zipper. The flap may secure over the zipper using hook and loop fasteners, such as Velcro™ hook and loop fasteners, and the like. In one embodiment, a portion of the flap may be sewn to the cover so as to bias the flap in a closed position over the zipper and/or prevent the flap from folding backward and exposing the zipper. In another embodiment, an outer flap may fold over an inner flap and couple with the cover body to effectively seal an outer periphery of the flap to prevent bed bug access to the encased or enclosed mattress.

In another embodiment, the zipper's teeth may be substantially small to minimize gaps or voids between coupled or zipped teeth and thereby prevent bed bugs or other undesirable insects from accessing the mattress through the coupled teeth. The material of the cover may be stitched or sewn over the teeth so that when zipped together the material one either side of the teeth abut to cover or conceal the zipper. Further, the chain or zipper width may be substantially small to draw the cover material together over the zipper and/or minimize gaps or voids between coupled teeth.

In another embodiment, the cover may include a barrier material coupled with one or more of the flaps and/or with an interior surface of the cover disposed at or near a distal end of the zipper. The barrier material may be adhesively bonded, sewn, or stitched to the flap and/or interior surface of the cover and may be foldable and securable over the zipper to cover the exterior and/or interior surface of the zipper. In one embodiment, the barrier material is pressed against on outer surface of the zipper via the coupling of the flap or flaps to the cover. In another embodiment, the barrier material minimizes a space between the inner surface of the zipper and the mattress and/or presses up against the inner surface of the mattress to discourage and/or prevent bed bugs from accessing the mattress. These and other features of the described covers will be more evident with reference to the embodiments shown in the figures described below.

Referring to FIG. 1, illustrated is a cover 100 sized to fit over a mattress 102 to encase or enclose the mattress 102 within the cover 100. Cover 100 includes a zipper 130 that may be zipped open so that the cover may be placed over mattress 102, and may zipped closed to encase or enclose mattress 102 within cover 100. Cover 100 also includes a flap 110 that is folded and secured over a zipper mechanism (e.g., zipper mechanism 140) to cover and protect the zipper mechanism. FIG. 1 shows a portion of the lower left corner of cover 100 removed to show mattress 102 positioned in the interior of cover 100.

Figure 2:
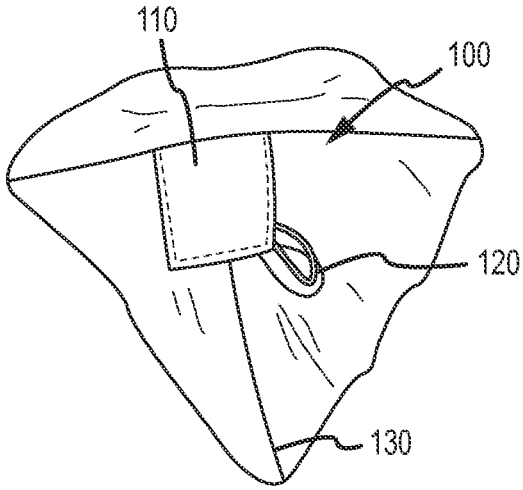
FIG. 2 illustrates a cover that may be fitted over and around a mattress according to an embodiment of the invention.

Referring now to FIG. 2, illustrated is a cover 100 that may be positioned over a mattress (not shown) to encase or enclose the mattress within the cover. The cover 100 includes a zipper 130 that may be zipped open so that cover 100 may be fitted over the mattress and that may be subsequently closed to encase or enclose the mattress within cover 100. A zipper mechanism (e.g., 140 of FIG. 3A) may be slid along a longitudinal length of zipper 130 to couple teeth of opposing zipper tracks (e.g., 142 and 144 of FIG. 4) together and thereby encase or enclose the mattress within cover 100.

Cover 100 includes a flap 110 positioned at a distal end of zipper 130. Flap 110 may be a rectangularly shaped material that is stitched or sewn to cover 100 along one end and that folds over a portion of zipper 130. It should be realized that flap 110 may include virtually any other shape as well including, oval, circular, square, hexagonal, octagonal, and the like. Flap 110 folds over zipper 130 and is securable with respect thereto to cover zipper 130 and a corresponding zipper mechanism (e.g., 140). Flap 110 may include a tab 120, such as a hoop sewn into flap 110, that may be grasped and pulled to fold flap 110 backward and uncover the zipper mechanism.

In some embodiments, flap 110 has a longitudinal length (e.g., a length extending along zipper 130) of between about 2 and about 4 inches, and more commonly about 2.5 inches. Flap 110 likewise may have a transverse length of between about 1.5 and about 3 inches, and more commonly about 2 inches. It should be realized that flap 110 could comprise various other sizes and shapes.

Figure 3A:
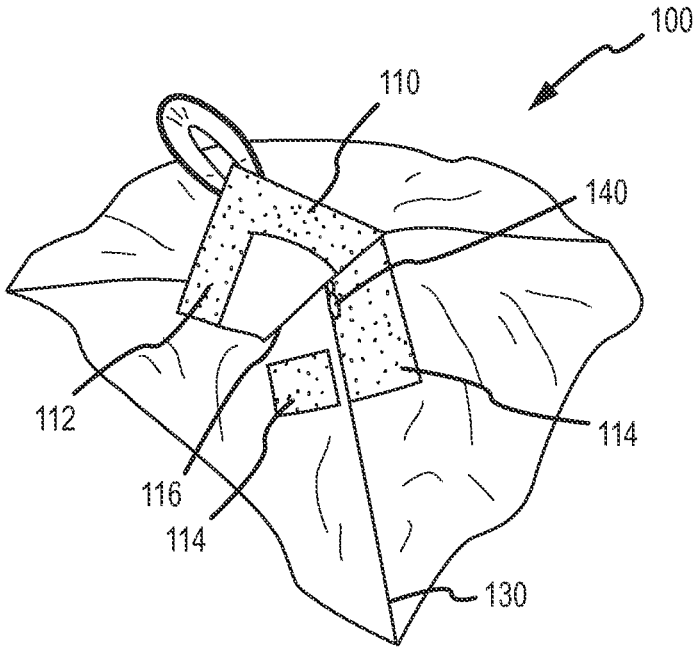
FIGS. 3A and 3B illustrate a cover having a flap folded back to reveal a zipper mechanism according to an embodiment of the invention.
Figure 3B:
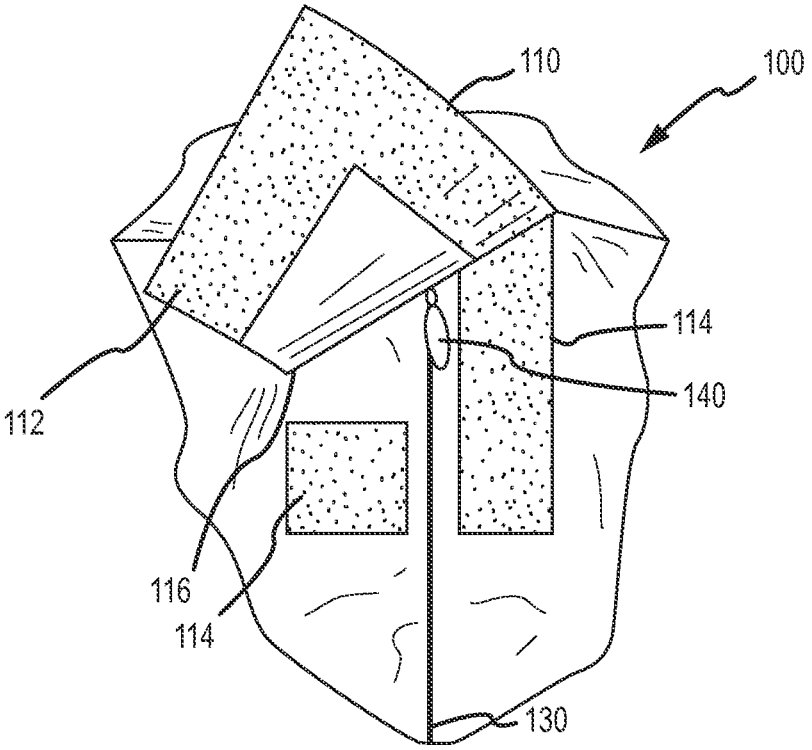

FIGS. 3A and 3B show flap 110 being folded backward to reveal zipper mechanism 140, which generally includes a slider that couples opposing teeth of zipper tracks (e.g., 142 and 144) together as zipper mechanism 140 is slid along a longitudinal length of zipper 130. Zipper mechanism 140 also includes a pull tab that is grasped by a user to slide slider longitudinally along zipper 130. Flap 110 may be fastened over zipper mechanism 140 using hook and loop fasteners, buttons, snaps, and the like. For example, flap 110 may include a loop tape or strip 112 that is stitched, sewn, or otherwise attached to flap 110, and cover 100 may include a corresponding hook tape or strip 114 (or vice versa) that is stitched, sewn, or otherwise attached to cover 100 adjacent a distal end of zipper 130. The hook and loop fastener may be pressed together to secure flap 110 over zipper mechanism 140 and/or a portion of zipper 130.

A portion or edge 116 of flap 110 may be secured to cover 100 to bias flap 110 closed over zipper mechanism 140 and/or prevent flap 110 from folding backward and uncovering zipper mechanism 140. For example, a portion (e.g., ⅓, ½, ⅔, and the like) of a longitudinal edge 116 (or the entire edge) of the rectangular shaped flap 110 may be sewn or stitched to cover 100 so that when tab 120 is grasped and pulled, flap 110 opens diagonally to reveal zipper mechanism 140 and so that when tab 120 is released, flap 110 is urged back over zipper 130 to cover zipper mechanism 140. Flap 110 minimizes access to the distal end of zipper track 130 and thereby discourages bed bugs and other undesirable bugs from accessing the mattress at the distal end of zipper 130.

Figure 4:
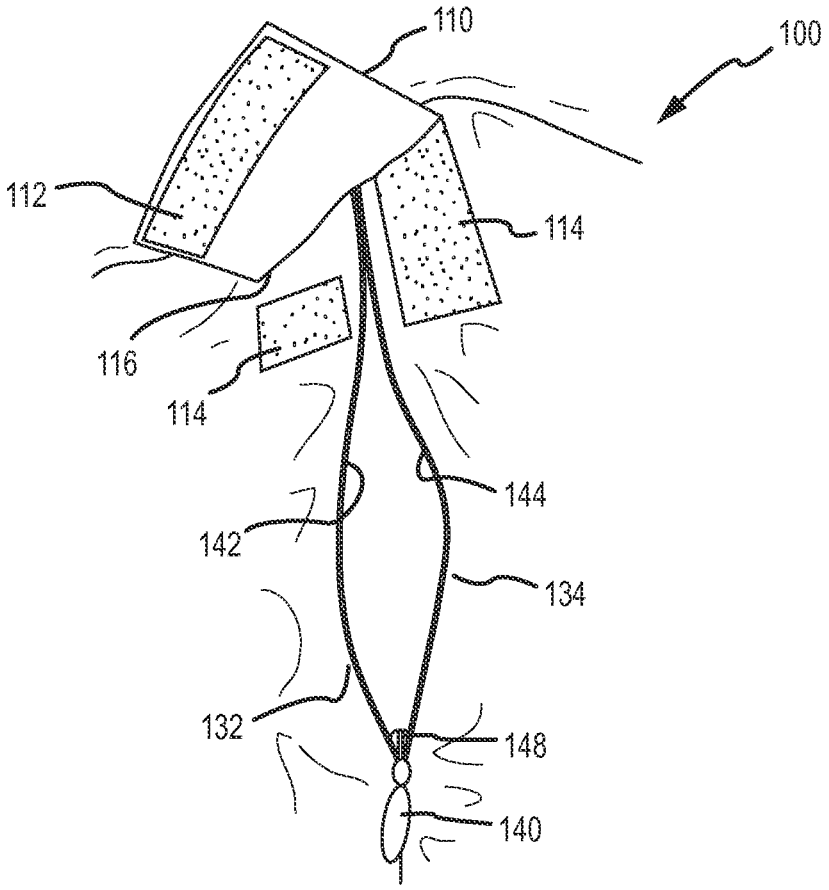
FIG. 4 illustrates a zipper mechanism slid proximally along a zipper to show opposing sides of the cover sewn over zipper tracks according to an embodiment of the invention.

The opposing teeth of the zipper tracks (e.g., 140 and 142 of FIG. 4) may be substantially small so as to minimize gaps or voids between coupled or zipped teeth. The small teeth may also allow the teeth to extend substantially to the distal end of zipper 130 so that zipper mechanism 140 may be zipped or slid substantially to the distal end of zipper 130 and so that a distal end of the zipper mechanism (e.g., end 148 of the slider as shown in FIG. 4) abuts or presses against the material of cover 100 (or a stop tab 118) at the distal end of zipper track 130. Because distal end 148 of zipper mechanism 140 presses against or abuts the material of cover 100 (or stop tab 118) when slide to the distal end of zipper 130, a gap or void between zipper mechanism 140 and the cover at the distal end of zipper 130 is minimized.

Figure 3C:
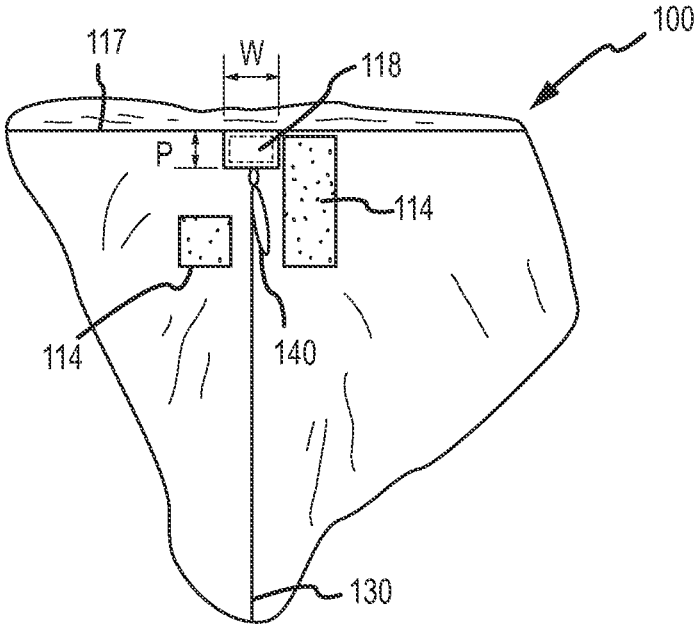
FIG. 3C illustrates the cover of FIGS. 2A and 2B having the flap removed to show a stop tab stitched at an end of the zipper according to an embodiment of the invention.

FIG. 3C shows cover 100 having flap 110 removed to show stop tab 118 sewn over zipper 130 at the distal end of the zipper. Specifically, stop tab 118 is sewn over zipper 130 at the distal end to prevent zipper 130 from widening or opening at the distal end due to repeated use and/or handling, which may cause stitching at the distal end to loosen or come undone. Stop tab 118 also limits the longitudinal travel of zipper mechanism 140 at the distal end, which prevents zipper mechanism from sliding out of zipper 130. Stop tab 118 also blocks bed bugs from crawling through a gap or hole at the distal end and accessing the interior of cover 100 and a mattress enclosed therein. A front portion of zipper mechanism 140 may slid under a proximal end of stop tab 118 to further limit any gaps or spaces between zipper mechanism 140 and stop tab 118. Stop tab 118 may extend longitudinally along zipper 130 from edge 117 a distance D and may be sewn onto cover 100 over the distal end of zipper 130 as shown. In some embodiments, distance D may be between about ⅛ and about ¾ inches, and more commonly about ¼ inch. Likewise, stop tab 118 may extend transversely across zipper 130 a distance W, which, in some embodiments, may be between about ¼ inch and about 1 inch.

Because flap 110 is covered and secured over zipper mechanism 140, flap 110 prevents objects from contacting and/or rubbing up against zipper mechanism 140 and increasing a void or space between zipper mechanism 140 and the distal end of zipper 130 (or stop tab 118) by sliding zipper mechanism 140 proximally along zipper 130. For example, as individuals (e.g., pant legs), pets, objects, and the like pass by or around a mattress enclosed with cover 100, flap 110 prevents such objects, pets, and/or individuals from brushing or rubbing up against or otherwise contacting zipper mechanism 140 and moving zipper mechanism 140 proximally along zipper 130 and/or withdrawing zipper mechanism from under stop tab 118. Flap 110 thus prevents or minimizes widening of any gaps or spaces between zipper mechanism 140 and the distal end of zipper 130 (or stop tab 118) by limiting or eliminating movement of the zipper mechanism 140 proximally along zipper 130.

The sewn portion of edge 116 helps prevent flap 110 from folding backward and revealing zipper mechanism 140 as individuals, pets, objects, and the like pass by cover 100 and contact or rub up against flap 110. Further, the sewn portion of edge 116 may bias flap 110 over zipper mechanism 140 and a portion of zipper 130 even when an individual, pet, or other object rubs up against flap 110 and/or folds it partially backward.

Figure 5:
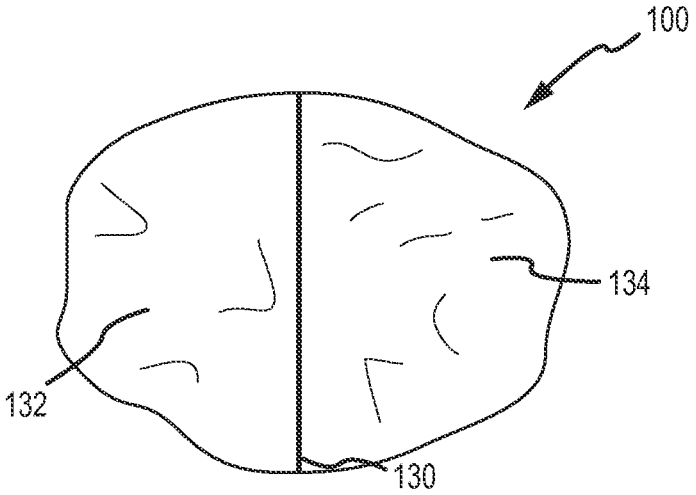
FIG. 5 illustrates material sewn to opposing sides of a zipper abuting so as to conceal the zipper according to an embodiment of the invention.

Referring now to FIGS. 4 and 5, shown is cover 100 with flap 110 folded backward and with zipper mechanism 140 slid proximally along zipper 130. FIG. 5 shows an enlarged view of zipper 130 and specifically shows an embodiment of a zipper configuration where the cover material on opposing sides of the zipper, 132 and 134, abut or contact each other to conceal the coupled zipper teeth and tracks, 142 and 144, beneath the cover material. As shown in FIG. 4, the cover material on opposing sides of the zipper, 132 and 134, may be sewn over zipper tracks, 142 and 144 respectively, so that when coupled together the zipper teeth and tracks, 142 and 144, are invisible or concealed. The cover material on opposing sides, 132 and 134, of zipper 130 may be sewn over zipper tracks, 142 and 144 respectively, so that the cover material is biased inwardly over the zipper tracks and teeth, the cover material abuts or contacts over the zipper 130 as shown in FIG. 5. For example, the zipper tracks, 142 and 144, may be sewn to the interior surface of cover 100 to bias opposing sides, 132 and 134, inward over zipper 130. The abutting or contacting cover material (e.g., sides 132 and 134) may prevent, block, or otherwise obstruct access to the zipper 130 concealed or hidden beneath the cover material and thereby prevent, block, or otherwise obstruct a bed bug from accessing the mattress through the zipper. The cover material on opposing sides of the zipper, 132 and 134, may be further biased together by using a zipper having a small chain or zipper width. The small chain or zipper width may further minimize gaps or voids between coupled teeth.

FIG. 4 also shows that when a barrier (e.g., barrier 150 of FIGS. 5A and 5B) is coupled with an interior surface of cover 100 near the distal end of zipper 130, zipper tracks, 142 and 144 are secured or held closely together, thereby minimizing gaps or voids associated with the zipper and/or zipper mechanism 140 at the distal end of zipper 130. The barrier is configured so that it presses firmly against zipper mechanism 140 at the distal end of zipper 130.

Figure 6A:
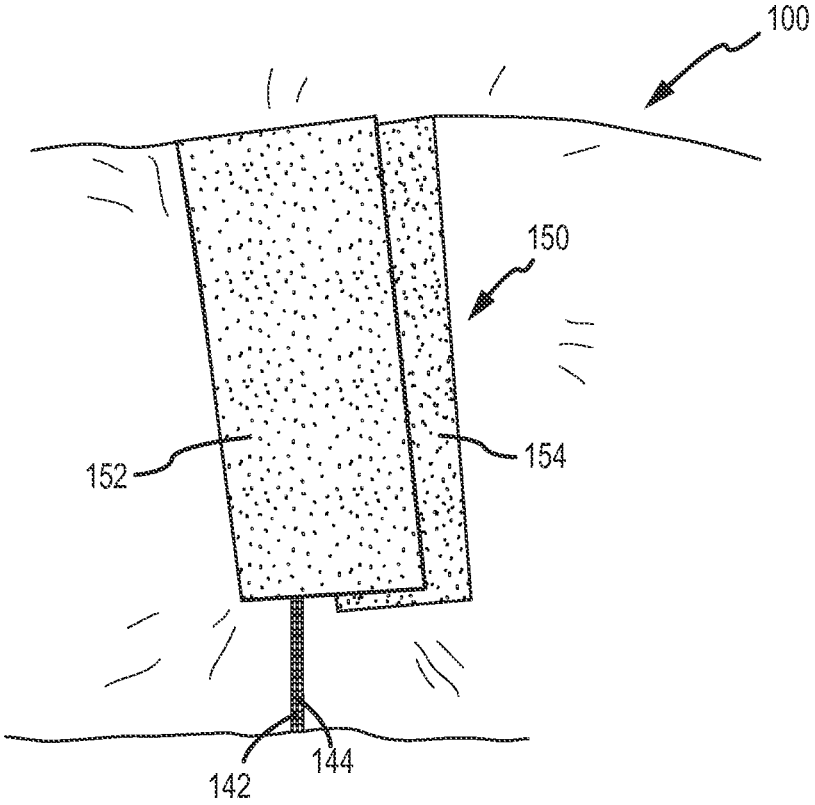
FIGS. 6A and 6B illustrate a barrier coupled with an interior surface of the cover at a distal end of the zipper according to an embodiment of the invention.
Figure 6B:
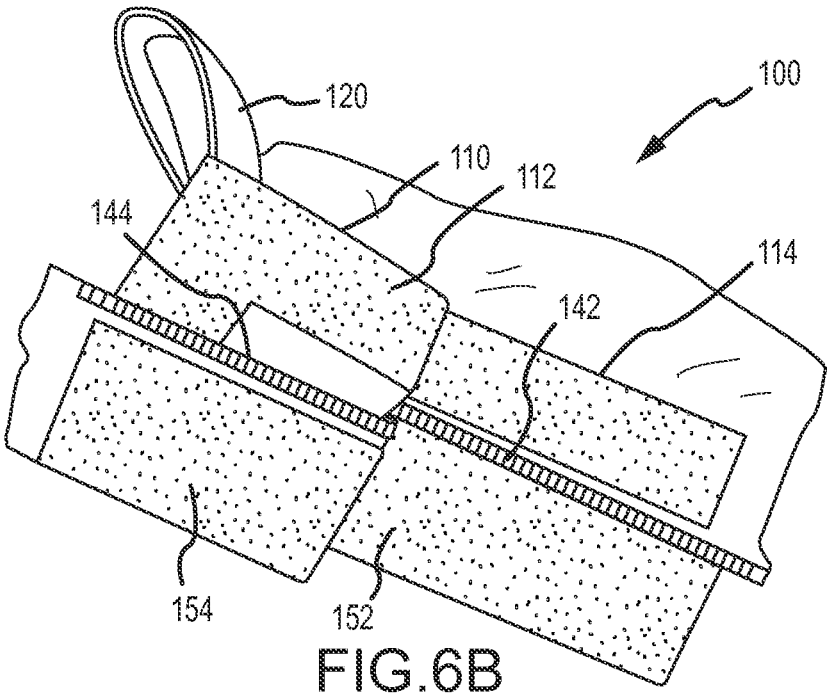

FIGS. 6A and 6B show a barrier 150 coupled with an interior surface of cover 100 at the end of zipper 130. In other words, barrier 150 is positioned on a side of the zipper 130 opposite flap 110. Barrier 150 is secured over a portion of the distal end of zipper 130 so that barrier 150 presses firmly against zipper mechanism 140 when the opening is zipped closed. Barrier 150 includes a flap 152 that folds and secures firmly over a distal portion of zipper 130. Flap 152 is sewn along an edge of zipper track 142 and configured to secure with zipper track 144. Flap 152 may be secured over zipper 130 and/or zipper mechanism 140 to zipper track 144 using hook and loop fasteners and the like. For example, flap 152 may include a plurality of loops on a surface that is pressed against a corresponding hook tape or strip 154 adjacent a distal end of zipper track 144. Hook tape or strip 154 may be stitched or sewn adjacent zipper track 144. Flap 152 may be folded over zipper 130 and/or zipper mechanism 140 and the hook and loop surfaces pressed together to secure flap 152 over zipper 130 and/or zipper mechanism 140. FIG. 6B shows flap 152 uncoupled from the hook tape or strip 154 adjacent zipper track 144.

When secured over zipper 130 and/or zipper mechanism 140, a top surface of barrier 150 (e.g., flap 152) presses firmly against a bottom surface of zipper 130 and zipper mechanism 140. This limits the amount of space within which a bed bug may crawl between zipper 130, zipper mechanism 140, and barrier 150. Likewise, when cover 100 is fitted over and around a mattress, the mattress fits snugly within cover 100 and presses firmly against barrier 150, thereby pressing barrier 150 firmly against zipper 130 (e.g., against zipper tracks 142 and 144) and zipper mechanism 140. This further limits the space between the top surface of barrier 150 and the undersurface of zipper 130 and zipper mechanism 140, which further limits the amount of space within which a bed bug may crawl and obstructs, blocks, or impedes a bed bug's access to the mattress.

In some embodiments, barrier 150 (e.g., flap 152) extends and is firmly securable along a longitudinal length of zipper 130 between about 2.0 inches and about 4.0 inches, and more commonly between about 2.5 and about 3.0 inches. This length provides a relatively long path that a bed bug must traverse to access the interior of cover 100 and a mattress encased therein. Since the barrier 150 is firmly pressed against zipper 130 along this length, it may be difficult for a bed bug to make such journey or seriously impede a bed bug from making such a journey. Exiting the cover 100 from the interior is likewise limited due the length and firm fit of the barrier 150 against zipper 130.

Figure 7A:
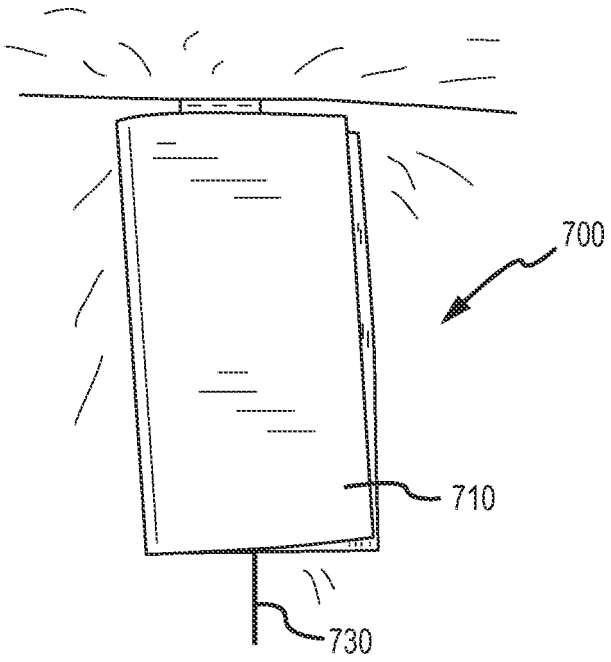
FIG. 7A illustrates another embodiments of a cover having overlapping flaps that fold and secure over zipper tracks according to an embodiment of the invention.
Figure 7B:
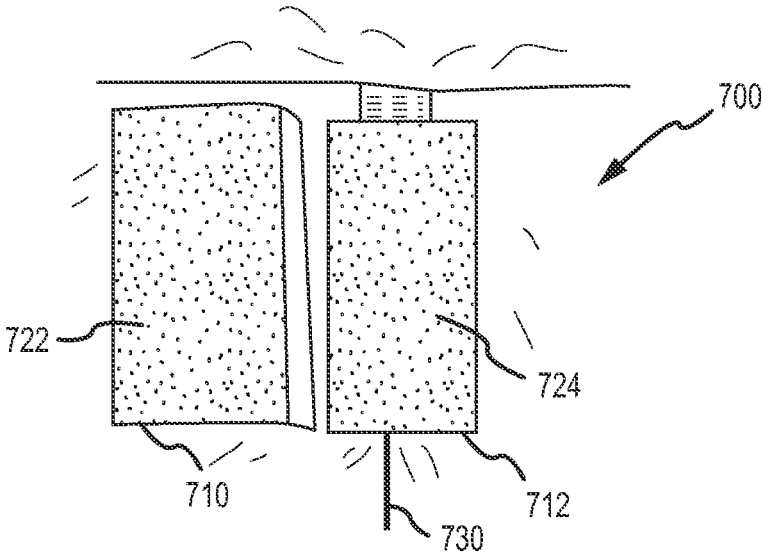
FIGS. 7B and 7C illustrate the overlapping flaps of FIG. 7A folded back to show various aspects of the flaps according to an embodiment of the invention.
Figure 7C:
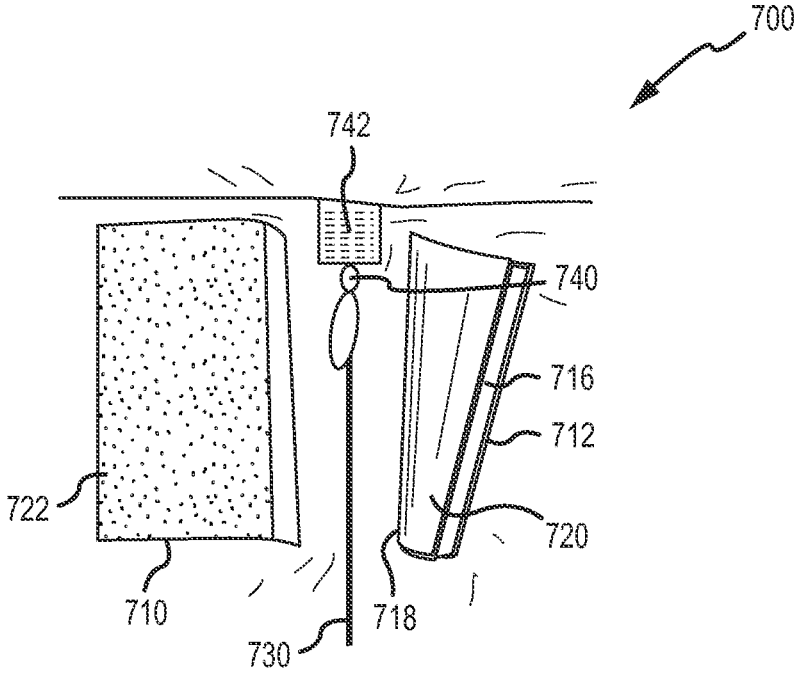

Referring now to FIGS. 7A-7C, illustrated is an embodiment of another cover 700 having overlapping flaps, (i.e., outer flap 710 and inner flap 712) that fold and couple over a distal end of zipper 730 so as to prevent or discourage bed bugs from accessing an enclosed mattress by crawling through the distal opening of zipper 730 (e.g., see distal opening 736). FIGS. 7B and 7C illustrate outer flap 710 folded backward to show inner flap 712. As described above, cover 700 of FIGS. 7A-7C may be positioned over a mattress (not shown) to encase or enclose the mattress within cover 700. Outer flap 710 and/or inner flap 712 may be a rectangularly shaped material that is stitched or sewn to cover 700 along one side and that fold over a portion of zipper 730, preferably the distal end of zipper 730. Outer flap 710 and/or inner flap 712 may include various other shapes including, oval, circular, square, hexagonal, octagonal, and the like.

Outer flap 710 and inner flap 712 fold over zipper 730 and are securable with respect thereto to cover zipper 730 and a corresponding zipper mechanism 740. Outer flap 710 and/or inner flap 712 may have a longitudinal length (e.g., a length extending along zipper 730) of between about 2 and about 4 inches, and more commonly about 2.5 inches and may likewise have a transverse length of between about 1.5 and about 3 inches, and more commonly about 2 inches, although other sizes could be used. Preferably, outer flap 710 and inner flap 712 are roughly equivalent in size so that the flaps may be easily folded and secured over zipper 730.

Outer flap 710 may be grasped and folded backward to uncover inner flap 712 as shown in FIG. 7B. Inner flap 712 may be sewn to cover 700 on a side of zipper 730 opposite outer flap 710. Inner flap 712 directly covers the distal end of zipper 730 and zipper mechanism 740. Outer flap 710 folds over and couples with inner flap 712 to tightly secure inner flap 712 and outer flap 710 over zipper 730 and/or zipper mechanism 740. In some embodiments, a top surface 724 of inner flap 712 includes a fastener that fastens or couples with a bottom surface 722 of outer flap 710. For example, top surface 724 and bottom surface 722 may include respective hooks and loops of a hook and loop fastening mechanism. In other embodiments, top surface 724 and bottom surface 722 may include buttons and buttons holes, snaps, adhesives, magnets, zipper mechanisms, and the like to tightly secure inner flap 712 and outer flap 710 over zipper 730 and/or zipper mechanism 740.

As shown in FIG. 7C, inner flap 712 may be folded backwards to uncover zipper 730 and zipper mechanism 740. In some embodiments, a bottom edge 718 of inner flap 712 is sewn to cover 700 so that inner flap 712 is biased toward a closed position in which flap 712 covers zipper 730 and/or zipper mechanism 740. Biasing inner flap 712 closed in this manner may help prevent the accidental opening of inner flap 712 as individuals, pets, and/or other objects brush past cover 700 and inner flap 712. This may help prevent bed bugs from having easy access to the distal end of zipper 730 and crawling through a distal opening of zipper 730 to access the enclosed mattress.

A bottom surface 720 of inner flap 712 directly contacts or covers zipper 730 and/or zipper mechanism 740. In some embodiments, bottom surface 720 includes a barrier material, such as a foam or fiber pad or material, coupled with inner flap 712. The foam or fabric pad may be stitched, adhered, or otherwise attached to inner flap 712. The foam or fabric pad may be between about 0.10 inches and about 1 inch thick, and more commonly between about 0.25 and about 0.50 inches. When inner flap 712 and outer flap 710 are folded and secured over zipper 730 and/or zipper mechanism 740, the foam or fabric pad presses tightly against zipper 730 to minimize the space throughwhich a bed bug may crawl. The tightly pressed foam or fabric pad discourages or prevents bed bugs from accessing the enclosed mattress by impeding or eliminating the bed bugs ability to crawl between cover 700 and the inner and outer flaps, 712 and 710. The bed bugs, thus, cannot easily access the distal end of zipper 730 and crawl through a gap or opening between the zipper mechanism 740 and a distal end of zipper 730 (e.g., distal opening 936). In effect, the tightly pressing foam or fabric pad seals the distal end of the zipper 730 to prevent or hinder bed bug access into the cover's interior. The tightly pressing foam or fabric pad also places pressure on zipper mechanism 740 thereby discouraging or minimizing proximal movement of zipper mechanism 740, thereby preventing or minimizing enlargement of the distal opening of zipper 730. Further, the tightly pressing foam or fabric pad may seal the distal end of the zipper 730 even when the zipper mechanism 740 moves proximally and the distal opening between zipper mechanism 740 and the distal end of zipper 730 is increased. Accordingly, the tightly pressing foam or fabric pad prevents or significantly discourages bed bug access to the cover 700's interior and the enclosed mattress even upon the occurrence of accidental opening of the zipper 730.

In some embodiments, bottom surface 720 includes a piece of fabric instead of or in addition to the foam material. The piece of fabric may directly contact and press tightly against zipper 730 and/or zipper mechanism 740 as described above to prevent or impede bed bugs from accessing the enclosed mattress. The piece (or several pieces) of fabric may be constructed or configured similar to loop fabric materials of hook and loop fasteners. In one embodiment, the "loop fabric" constructed piece of fabric may include small sized threads so that the piece of fabric is soft and/or may include a thick material cross section (e.g., 0.5 inches and the like) and/or high fiber density. The high fiber density, thick cross section, and/or softer fabric material may hinder or prevent a bed bugs movement across or through the portion of the piece of fabric contacting the cover and/or zipper 730 by entangling, entrapping, or otherwise limiting the bed bug's ability to crawl along zipper 730 or between the cover and piece of fabric. In other embodiments, a foam material layer 716 may be sandwiched between inner flap 712 and a fabric bottom surface 720. As described previously, foam material layer 716 may be up to about 1 inch thick, and more commonly up to about 0.50 inches. Foam material layer 716 may facilitate in tightly pressing fabric bottom surface 720 against zipper 730 and/or zipper mechanism 740 to minimize the space through which a bed bug may crawl.

The fabric and/or foam material of bottom surface 720, or used therewith, may be treated with an inherent bed bug repellant to offer an additional level of protection against bed bugs and further prevent or minimize bed bugs from accessing the enclosed mattress. FIG. 7C also illustrates a distal portion 742 of zipper 730 being stitched to prevent distal movement of zipper mechanism 740 along zipper 730. Stitched distal portion 742 extends across zipper 730 and may correspond to a stop tab (e.g., stop tab 944) that is stitched or otherwise coupled with an inner surface of cover 700 at the distal end of zipper 730. Stitched distal portion 742 helps minimize a gap or opening between zipper mechanism 740 and the distal end of zipper 730 by allowing the distal end of zipper mechanism 742 to be abutted closely or tightly against the stitching of stitched distal portion 742. It also helps prevent the distal teeth of zipper 730 from opening and thereby providing an access point for bed bugs.

Figure 8A:
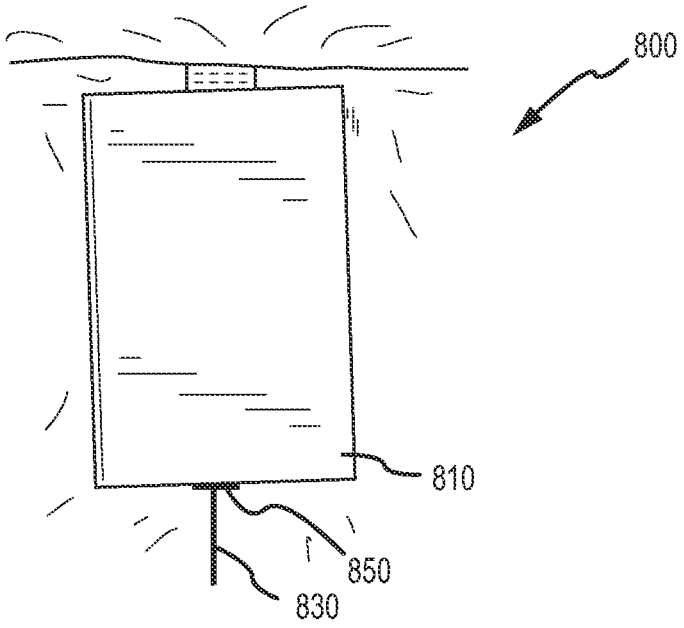
FIG. 8A illustrates another embodiment of a cover having a flap that folds over zipper tracks according to an embodiment of the invention.
Figure 8B:
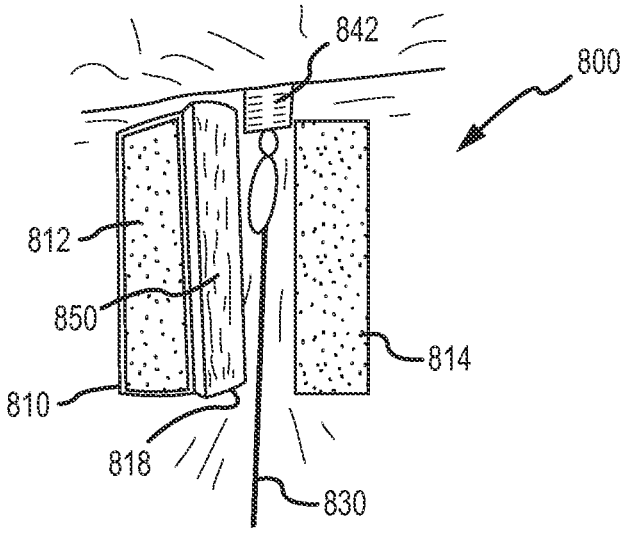
FIG. 8B illustrates the flap of FIG. 8A folded back to show various aspects of the flap according to an embodiment of the invention.

Referring now to FIGS. 8A and 8B, illustrated is another embodiment of a cover 800 having a flap 810 that folds and couples or secures over zipper 830 and/or a corresponding zipper mechanism (not shown) to prevent or discourage bed bug access to an enclosed mattress. Flap 810 includes foam or fabric material or pad 850 (referred to as a foam pad) that directly contacts zipper 830 and/or the zipper mechanism. In some embodiments, foam pad 850 may be or include a piece of fabric as described in FIGS. 7A-7C above. Flap 810 is secured over zipper 830 so that, as described above, foam pad 850 is pressed tightly against zipper 830 and/or the zipper mechanism to minimize the space through which a bed bug can crawl and access the opening at the distal end of zipper 830, seal zipper 830, provide pressure on the zipper mechanism, and/or prevent or minimize enlargement of a distal opening of zipper 830.

FIG. 8B illustrates flap 810 folded backward to show foam pad 850 and a fastening mechanism that secures flap 810 over zipper 830. As shown, foam pad 850 may be a strip of material that traverses along a longitudinal length of zipper 830 and that is sized larger than zipper 830 so that the foam pad extends across zipper 830. The foam pad 850 strip may extend longitudinally along a portion or the entire length of flap 810 and may be substantially centered transversely with respect to flap 810. Flap 810 may be folded over zipper 830 and secured tightly to an opposite side so that foam pad 850 is pressed securely against zipper 830 and/or the zipper mechanism to seal zipper 830 as described above. The distal end of zipper 830 may thus be sealed under foam pad 850 so that access to the distal end of zipper 830 and/or a distal opening is prevented or significantly restricted.

In some embodiments, foam pad 850 strip may be between about 2.0 inches and about 4.0 inches long, and more commonly between about 2.5 and about 3.0 inches, and may be between about 0.25 and about 2 inches wide, and more commonly between about 0.50 and 1 inch. The foam pad 850 may likewise be up to about 1 inch thick and more commonly about 0.50 inches.

Flap 810 may be stitched or otherwise coupled with cover 800 along one side of the flap and on one side of zipper 830. A fastening mechanism may be positioned on an opposite side of zipper 830 so that flap 810 may be folded and secured over zipper 830. The fastening mechanism may include hooks (or loops) 814 of a hook and loop fastener that is stitched or otherwise coupled with cover 800. A bottom surface of flap 810 may have corresponding loops (or hooks) 812 that secure with hooks 814. Other fastener types may be used, such as buttons, snaps, adhesives, magnets, and the like. Further, as described above, a bottom edge 818 of flap 810 may be stitched to cover 800 to bias flap 810 toward a closed position covering zipper 830 and/or the zipper mechanism. Cover 800 may also include a stitched distal portion 842 similar to that described with respect to FIG. 7C that limits distal motion of the zipper mechanism and minimizes an opening at the distal end of zipper 830. FIG. 8B shows foam pad 850, zipper 830, hooks 814, loops 812, and the stitched distal portion 842 of zipper 830. Of particular note is that, in some embodiments, the fastening mechanism (e.g., hook or loop 814) of cover 800 may be positioned on only one side of zipper 830, although other embodiments may include the fastening mechanism on both sides of zipper 830.

Figure 10A:
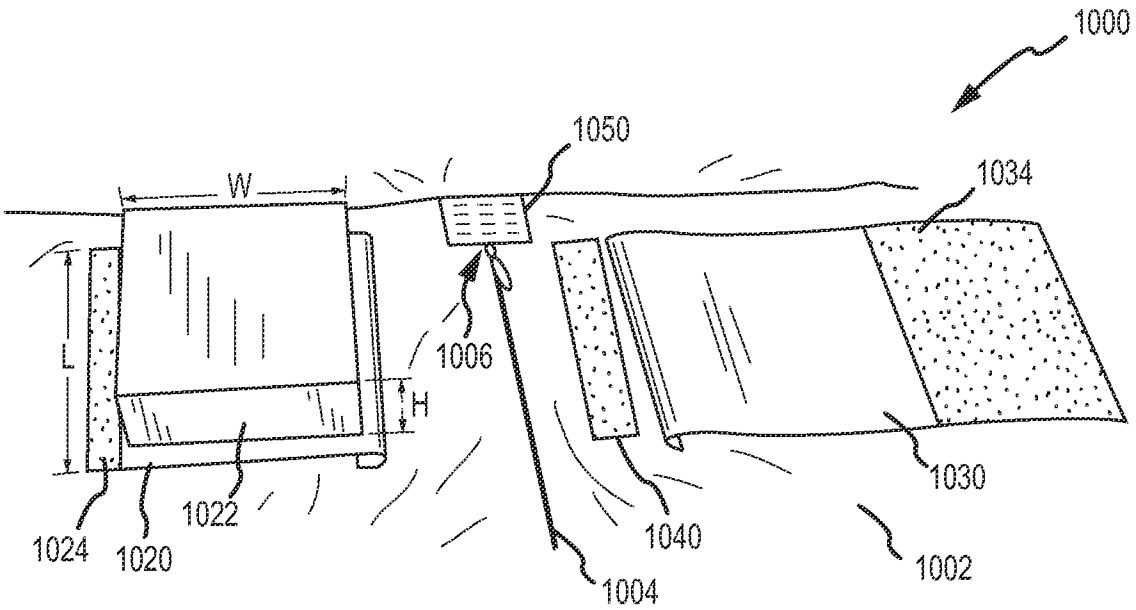
FIGS. 10A-E illustrate various embodiments of covers having flaps that may be folded and secured over a distal end of a cover's zipper.

Although foam pad 850 is shown as a strip of material coupled with or stitched to flap 810, in some embodiments foam pad 850 extends substantially across the bottom surface of flap 810 as shown in FIG. 10A. As described above with respect to FIGS. 7B and 7C, flap 810 may include a fabric material that cover foam pad 850. The fabric material and/or foam pad may likewise include a bed bug repellant to offer an additional level of protection. Further, the zippers, 730 and 830, of covers, 700 and 800, may be configured so that opposing sides of the zipper abut or contact each other to conceal the coupled zipper teeth and zipper tracks beneath the cover material as shown in FIG. 4.

Figure 9:
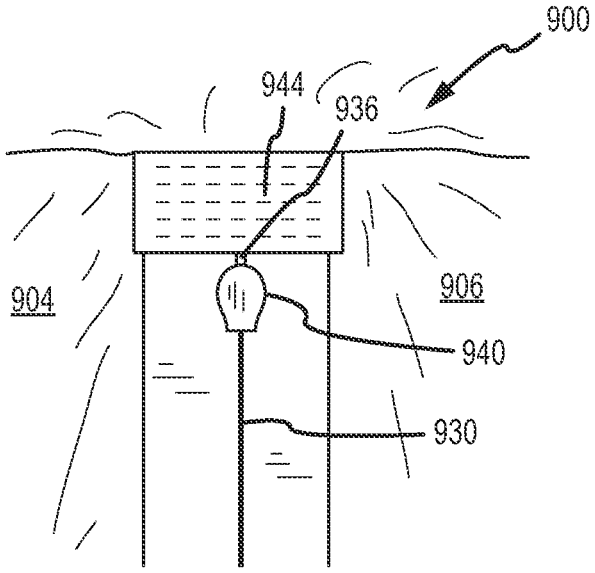
FIG. 9 illustrates a stop tab stitched to an inner surface of the cover at an end of the zipper according to an embodiment of the invention.

Referring now to FIG. 9, illustrated is a stop tab 944 stitched to an inner surface of a cover 900 at a distal end of zipper 930. Cover 900 may represent any of the cover described herein. Stop tab 944 may be stitched or otherwise coupled with cover 900 so that stop tab 944 extends from one side 904 of cover 900 across the distal end of zipper 930 to an opposite side 906 of cover 900. Zipper mechanism 940 may be zipped distally along zipper 930 until zipper mechanism 940 closely and tightly abuts stop tab 944. A distal opening 936 of zipper 930 may be minimized since zipper mechanism 940 may be tightly abutted against stop tab 944. Stop tab 944 may also prevent distal teeth of zipper 930 from separating and, thereby, prevent distal opening 936 from widening or increasing in size. As such, a bed bug's access through distal opening 936 may be minimized or greatly restricted.

Referring now to FIGS. 10A-10D, illustrated is an embodiment of another cover, covering, or encasement 1000 that folds over a distal end of a zipper 1004 to cover the zipper and/or apply pressure to the zipper to minimize a space through which a bed bug may crawl. Cover 1000 includes a fabric body 1002 having an opening that allows the mattress or box-spring (not shown) to be inserted within the body. Zipper 1004 is coupled with the opposing sides of the opening and includes a zipper mechanism 1006 that slides or is distally advanced along zipper 1004 to couple opposing teeth of the zipper as known in the art to allow the opening to be zipped closed and thereby encase or enclose the mattress or box-spring within cover 1000.

A stop 1050 may be coupled with cover 1000 at a distal end of zipper 1004 to limit the distal movement of zipper mechanism 1006 along zipper 1004. Stop 1050 may be a tab, or a piece of fabric or other material, that is shown across zipper 1004 or may include stitching that is sewn laterally across zipper 1004. Stop 1050 allows the distal end of zipper mechanism 1006 to contact or abut the stop 1050 thereby minimizing any space or gap that exists between the distal end of zipper mechanism 1006 and the distal end of the zipper 1004. In other words, since the distal end of zipper mechanism 1006 directly abuts stop 1050, there is less of a chance or concern that the zipper mechanism 1006 will retract proximally along zipper 1004 and open or widen any gap or space that may exist between the distal end of zipper mechanism 1006 and the distal end of zipper 1004. Likewise, the stop 1050 may prevent or reduce lateral forces on opposing sides of zipper 1004 that could cause zipper mechanism 1006 to retract proximally along zipper 1004. For example, as users sit or lay atop an enclosed or encased mattress, or otherwise handle the mattress and cover, the fabric of cover 1000 may stretch and conform to any movement or handling. Without stop 1050, this stretching and conformance of cover 1000 may cause opposing sides of the distal end of zipper 1004 to pull slightly apart, which may cause zipper mechanism 1006 to proximally retract along zipper 1004. Since bed bugs are very small, even slight refraction of zipper mechanism 1006 along zipper 1004 may create relatively wide gaps through which the bed bugs may crawl and access the enclosed mattress. Stop 1050 helps reduce or eliminate proximal movement of zipper mechanism 1006 by reducing or eliminating forces that would pull opposing sides of the distal end of zipper 1004 apart.

Cover 1000 includes a flap 1020 that is foldable and securable over the distal end of zipper 1004. Flap 1020 may be a square or rectangular piece of material, or multiple pieces of material, that is stitched, adhesively bonded, or otherwise coupled along one of its edges to fabric body 1002. Preferably, an inner edge proximal to zipper 1004 is stitched to the fabric body 1002. Flap 1020 folds laterally over zipper 1004 to cover the distal end of the zipper and to cover zipper mechanism 1006. Flap 1020 may have a width and/or longitudinal length of between 1 and 5 inches, although 2 inches is more common. Flap 1020 may also include various other dimensions and/or shapes (e.g., circular, oval, and the like).

Flap 1020 may include a fastener 1024 that releasably couples with fastener 1040 of fabric body 1002 disposed on the opposite side of zipper 1004 so that flap 1020 is securable to fabric body 1002 covering zipper mechanism 1006 and the distal end of zipper 1004. In one embodiment, fasteners 1024 and 1040 include hook and loop fasteners, although other fasteners may be used including: buttons, pins, clips, magnets, adhesive bonds, and the like. Also, fasteners 1024 and 1040 may extend along an entire edge of flap 1020, or along one or more portions thereof. Preferably, fasteners 1024 and 1040 extend along the entire edge and are configured so that the entire edge is coupled, fastened, or otherwise secured to fabric body 1002. Fastening the entire edge in this manner effectively seals the edge of flap 1020 to fabric body 1002 thereby preventing bed bug access through the edge to the enclosed mattress. To seal the edge in this manner, hook and loop fasteners, magnets, longitudinally extending pins or clips, and the like may be preferred.

Flap 1020 may also include a barrier material 1022 coupled with an inner face or surface of flap 1020. Barrier material 1022 may be adhesively bonded or otherwise attached to flap 1020. Barrier material 1022 (referred to hereinafter as foam or foam pad 1022) may include a strip of material, such as a piece of foam, leather, rubber, plastic, and the like. The barrier material 1022, flap 1020, and fastener 1024 may be configured to apply pressure to and/or along zipper 1004 when the flap is folded and secured over zipper 1004. For example, when folded and secured over zipper 1004, flap 1020 may compress the barrier material 1022 against zipper 1004, thereby eliminating or reducing any space or gap between zipper 1004 and fabric body 1002, flap 1020, and/or barrier material 1024 through which a bed bug may crawl. In this manner, a beg bug's ability to crawl along zipper 1004 and access the enclosed or encased mattress or box-spring (not shown) via the distal end of the zipper 1004 is significantly impeded or eliminated.

In one embodiment, foam pad 1022 may have a height H between about ⅛ inch and 1 inch, a width W between about ⅓ inch to 3 inches, and a length L between about 1 inch and 3 inches. In another embodiment, foam pad 1022 includes a height H of about ¼ to ½ inch, a width W of 1 to 2 inches, and a length of about 2 inches. The width W and length L may correspond to the dimensions of flap 1020 so that length L is about the length of flap 1020 and width W is slightly less than the width of flap 1020 to allow room for fastener 1024 to be positioned on or near an edge of flap 1020. In another embodiment, the width W of foam pad 1022 is relatively thin (e.g., ⅓ to ¾ inch) and the length L is relatively long (e.g., 1 to 3 inches) so that the foam pad is positioned directly above and pressure is applied directly to zipper 1004. An example of such a configuration is pad 850 shown in FIG. 8B.

Foam pad 1022 may be made of a conventional polyurethane material having a high resiliency and/or may include viscoelastic foam, latex foam, and the like. The foam pad 1022 may have a foam density of between about ½ lb/ft$^3$ and 7 lb/ft$^3$. Similarly, foam pad 1022 may have an indentation force deflection (IFD) or indentation load deflection (ILD) of between about 7 lbs. and 65 lbs. Preferably, foam pad 1022 is configured to conform to the surface of the fabric body 1002, zipper 1004, and zipper mechanism 1006 so that foam material substantially contacts the surfaces of said components to minimize gaps, voids, or spaces through which or along which a bed bug may crawl.

In some embodiments, cover 1000 includes a second flap 1030 that is positioned on the opposite side of zipper 1004 and that is foldable laterally over and securable over flap 1020 so as to cover flap 1020. Flap 1030 may be a square or rectangular piece of material, or multiple pieces of material, that is stitched, adhesively bonded, or otherwise coupled along one of its edges to fabric body 1002. Preferably, an inner edge of flap 1030 proximal to zipper 1004 is stitched to the fabric body 1002 similar to flap 1020. Flap 1030 may also include dimensions and/or other shapes similar to flap 1020. Flap 1030 may also include a fastener 1034 that releasably couples or fastens with a fastener 1060 of fabric body 1002 (see FIG. 11A) disposed on the opposite side of zipper 1004 so that flap 1030 may be secured to fabric body 1002 covering flap 1020, zipper mechanism 1006, and the distal end of zipper 1004. When secured to fabric body 1002, flap 1030 may apply pressure to flap 1020 that is transferred to zipper 1004 and/or may reinforce flap 1020 in the secured position to prevent flap 1020 from becoming uncoupled with fabric body 1002. Fasteners 1034 and 1060 may include hook and loop fasteners and/or any of the previously described fasteners.

Figure 10B:
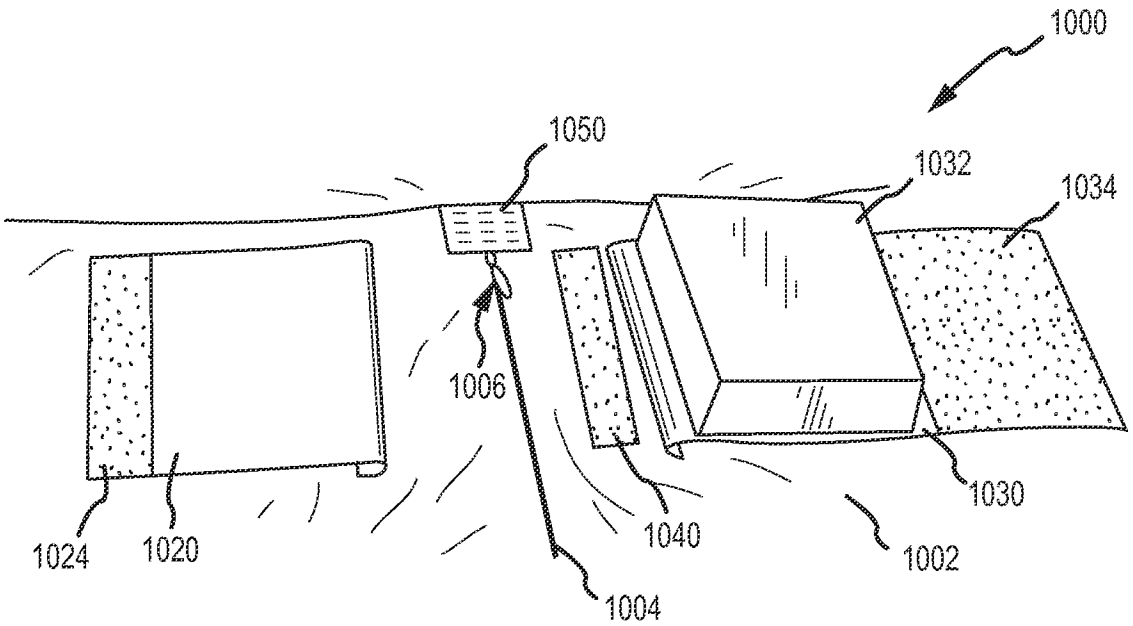

FIG. 10B illustrates an alternative embodiment of cover 1000. In this embodiment, flap 1020 does not include barrier material 1022. Rather, a barrier material 1032 is coupled with flap 1030 (e.g., via adhesive bonding, stitching, and the like). Barrier material 1032 (referred to hereinafter as foam pad 1032) may include materials and/or dimensions similar to those described for barrier material 1022 and may be pressed against flap 1020 when flap 1030 is folded and secured over flap 1020 via fastener 1034. In this manner, pressure may be transferred from flap 1030 to flap 1020 and subsequently to zipper 1004 to reduce or eliminate any spaces or gaps existing between zipper 1004 and flap 1020 and/or fabric body 1002.

Figure 10C:
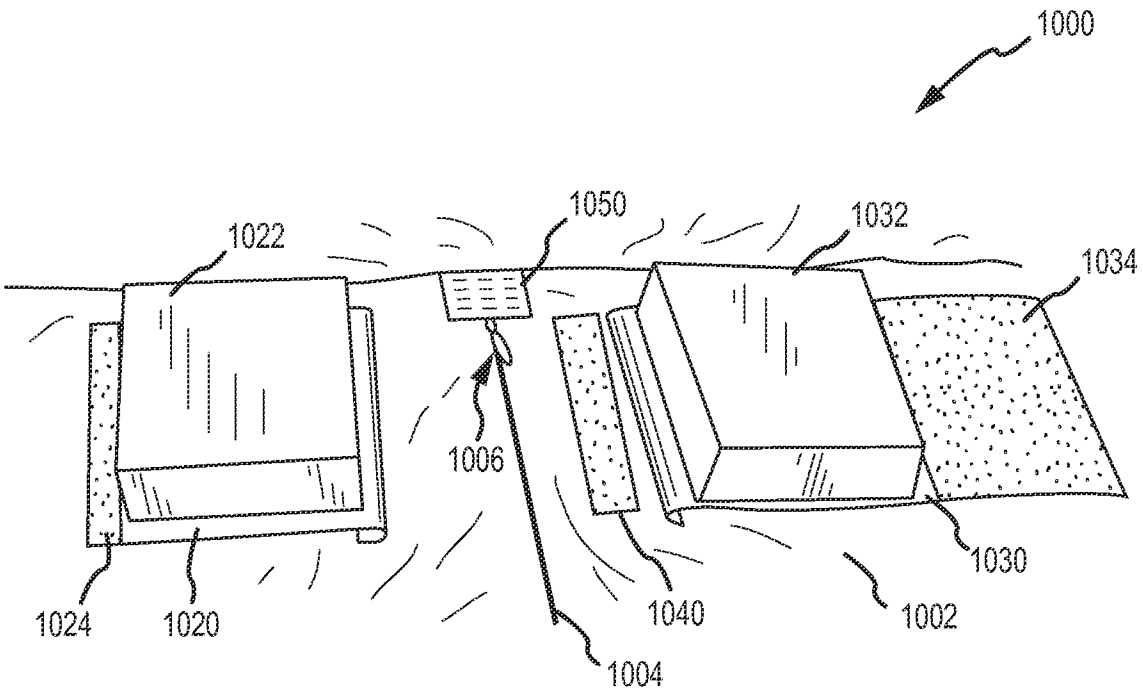

FIG. 10C illustrates another embodiment of cover 1000. In this embodiment, both flaps 1020 and 1030 include foam pads 1022 and 1032 respectively. As described previously, when folded and secured over zipper 1004, flap 1020 and foam pad 1022 may provide pressure to zipper 1004 and zipper mechanism 1006. Likewise, flap 1030 and foam pad 1032 may provide pressure to flap 1020, zipper 1004, and zipper mechanism 1006 when folded and secured over flap 1020. In this manner, the pressure provided by flap 1030 and foam pad 1032 may reinforce and/or increase the pressure provided by flap 1020 and foam pad 1022 to zipper 1004 thereby allowing an increased amount of pressure to be applied than may otherwise be possible. In some embodiments, the foam pads, 1022 and 1032, may have different sizes and/or dimensions. For example, foam pad 1022 may be skinny and long so that pressure is applied directly to and/or adjacent zipper 1004 while foam pad 1032 is both wide and long so that pressure is applied substantially evenly to the outer surface of flap 1020.

Figure 10D:
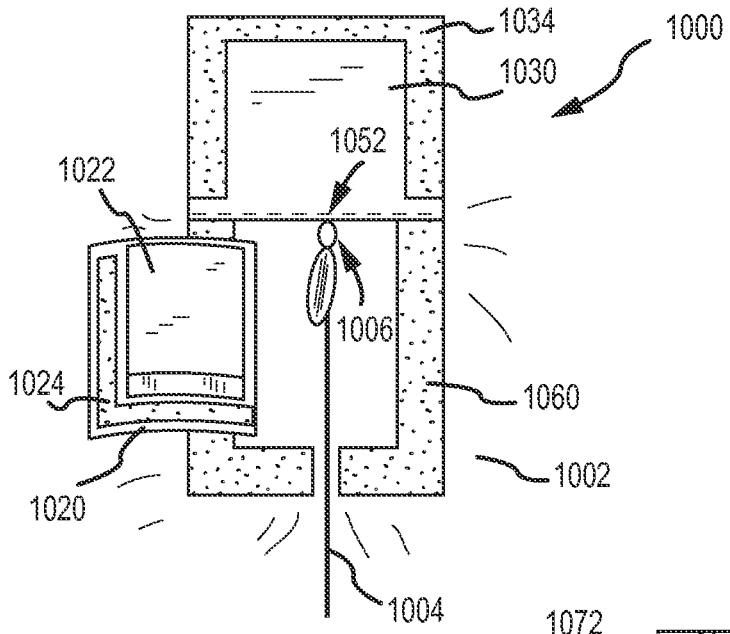
Figure 10E:
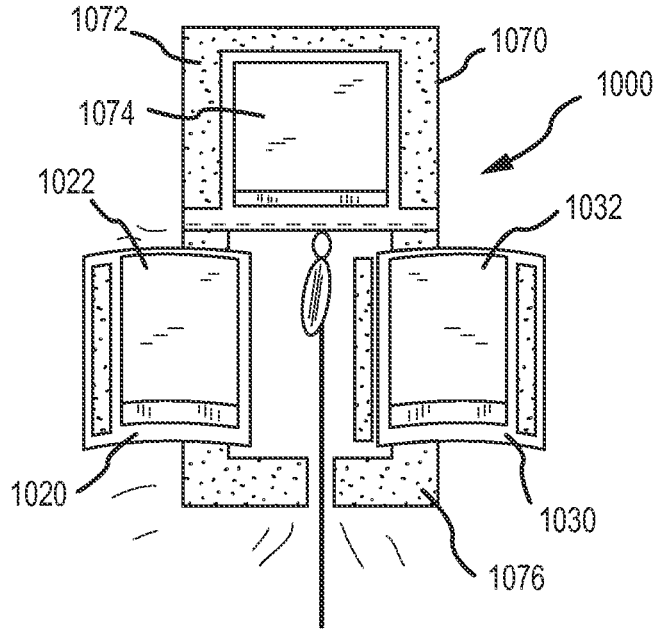

FIGS. 10D and 10E illustrate other embodiments of cover 1000. FIG. 10D illustrates an embodiment where flap 1030 is positioned approximately 90 degrees relative to flap 1020 so that flap 1030 folds orthogonally over flap 1020 in a direction aligned with zipper 1004. An inner edge of flap 1030 may be coupled with fabric body 1002 by stitching or adhesively bonding the inner edge to fabric body 1002. In one embodiment, the inner edge is stitched to fabric body 1002 so that a portion 1052 of the stitching extends laterally across zipper 1004. This portion 1052 of the inner edge may function as a distal stop to limit the distal travel of zipper mechanism 1006 and/or prevent proximal retraction of the zipper mechanism 1006 as previously described. The fastener 1034 of flap 1030 may extend fully or partially around the outer periphery of flap 1030 and may be coupled with a corresponding fastener 1060 of fabric body 1002 so that the outer periphery of flap 1030 may be partially or fully coupled with fabric body 1002. Fasteners 1034 and 1060 may be any of the fasteners described herein (e.g., hook and loop fasteners and the like). Although not shown, flap 1030 may include a barrier material that is pressed against flap 1020 as previously described.

Flap 1020 may be laterally folded and secured over zipper 1004 and may or may not include a foam pad 1022 as previously described. Once flap 1020 is secured over zipper 1004, flap 1030 may be folded orthogonally over flap 1020. The outer periphery of flap 1030 may be secured to fabric body 1002 via fasteners 1034 and 1060 so that the outer periphery of flap 1030 is partially or fully coupled with fabric body 1002. One advantage of this configuration is that essentially the entire outer periphery of flap 1030 may be closely coupled with fabric body 1002 to effectively seal the outer periphery of flap 1030 and thereby prevent bed bugs from crawling through any of the sides of flap 1030 and accessing the interior of the coupled flap 1030. With the outer periphery sealed in this manner, the only access may be via zipper 1004, which having the tight edge and teeth configuration described above and the pressure applied by foam pad 1022 and/or a foam pad coupled with flap 1030 (not shown), greatly restricts or eliminates the bed bud's movement or ability to crawl through and/or along zipper 1004. As such, bed bugs may be prevented from accessing the interior of the coupled flap 1030 and crawling through or along zipper 1004 and reaching zipper mechanism 1006. Although not shown, flap 1030 may also include a foam pad that presses against flap 1020 as previously described.

FIG. 10E shows a cover 1000 having three flaps: flap 1020 that folds and secures laterally over zipper 1004, flap 1030 positioned on an opposite side of zipper 1004 and that folds and secures laterally over flap 1020, and flap 1070 positioned approximately 90 degrees relative to flaps 1020 and 1030 that folds and secures orthogonally over flaps 1020 and 1030. Each of the flaps, or any combination thereof, may include foam pads (i.e., foam pads 1022, 1032, and 1074). Flaps 1020 and 1030 may each be folded laterally over zipper 1004 as previously described, after which flap 1070 may be folded and secured over flaps 1020 and 1030. The entire outer periphery of flap 1070 may include a fastener 1072 that couples with a corresponding fastener 1076 of fabric body 1002 and the effectively seals a portion or the entire periphery of flap 1070 as previously described. Flap 1070 may also function as a distal stop for zipper mechanism 1006.

In some embodiments, any or all of the foam pads described herein may include an insect repellant additive, such as a topical treatment that is applied to the foam pad or an additive that is added to the foam pad material during manufacturing. The insect repellant additive may further discourage bed bugs from crawling along the zipper or through the secured flaps to the zipper mechanism and thereby accessing the enclosed or encased mattress or box-spring. In one embodiment, the insect repellant additive includes a citrus based extract that is applied topically to the foam pad and/or to the foam pad material during manufacturing. Preferably, an inner pad positioned directly above the zipper that applies pressure to the zipper includes the insect repellant additive to discourage potential bed bug movement or access.

Figure 11A:
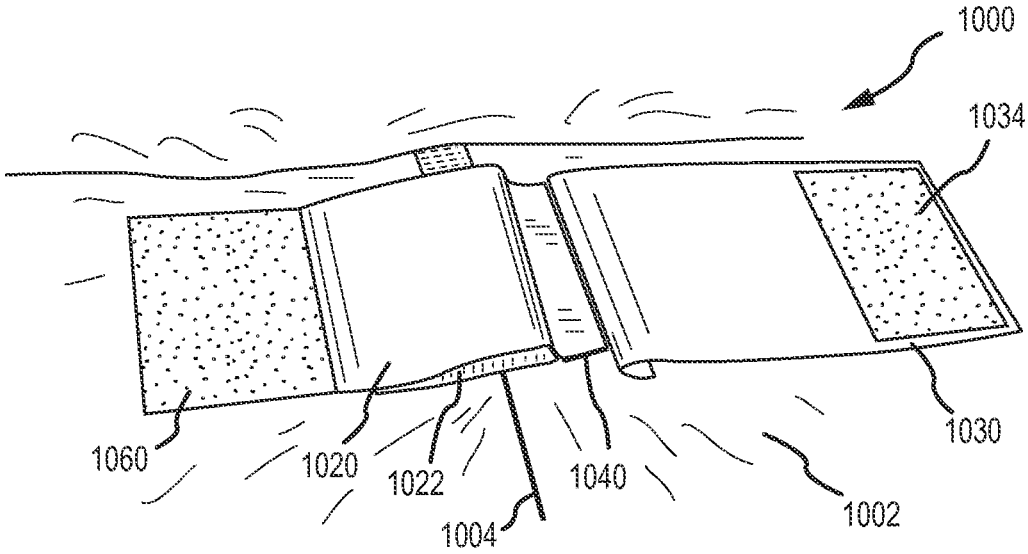
FIGS. 11A-D illustrate the various covers of FIGS. 10A-E being folded and secured over the cover's zipper.
Figure 11B:
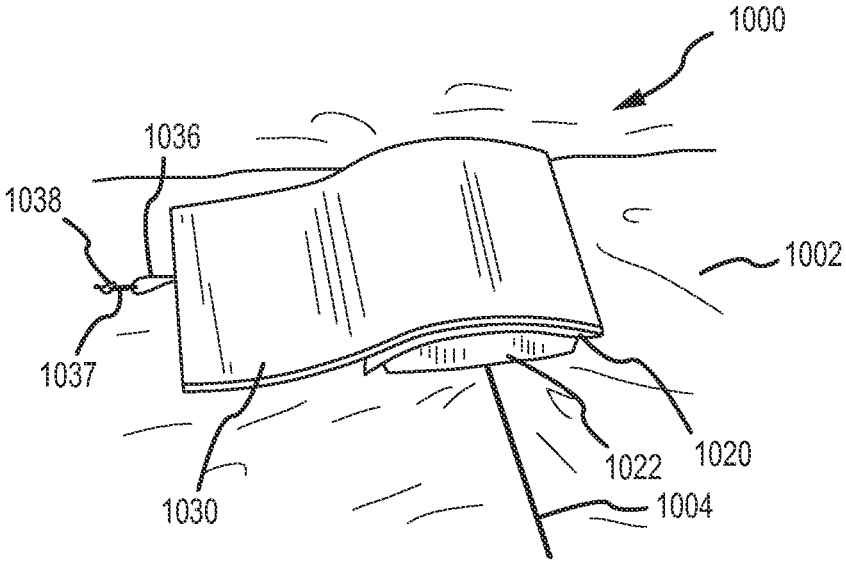

FIGS. 11A-D illustrate the various covers 1000 described above being folded and secured over zipper 1004. FIG. 11A shows flap 1020 being folded laterally over zipper 1004 and secured relative thereto via fasteners 1024 and 1040. With flap 1020 folded over zipper 1004, fastener 1060 that couples with fastener 1034 of flap 1030 is revealed. FIG. 11A also shows foam pad 1022 being pressed against zipper 1004 via the secured flap 1020. FIG. 11B shows flap 1030 folded laterally over flap 1020 and secured relative thereto via fasteners 1034 and 1060. Foam pad 1022 presses against zipper 1004 and flap 1030 reinforces the coupling of flap 1020 to fabric body 1002. As shown, flap 1030 may be laterally longer or wider than flap 1020 to provide an extra coupling surface or tab to which fastener 1034 is attached. Fastener 1060 may also be large compared to fastener 1040 to provide a bigger coupling area for attachment to flap 1030. Flap 1030 may also include an additional fastener 1036 that couples with an additional fastener 1038 of fabric body 1002. In one embodiment, additional fasteners 1036 and 1038 include fabric hoops that are coupled via a tie 1037, which may be plastic, fabric, metallic, and the like. In another embodiment, fastener 1038 includes a button that is inserted through hoop 1036 or a slot (not shown) cut into flap 1030. In yet another embodiment, fasteners 1036 and 1038 includes snaps that are snapped together. Various other fastener configurations are also possible.

Figure 11C:
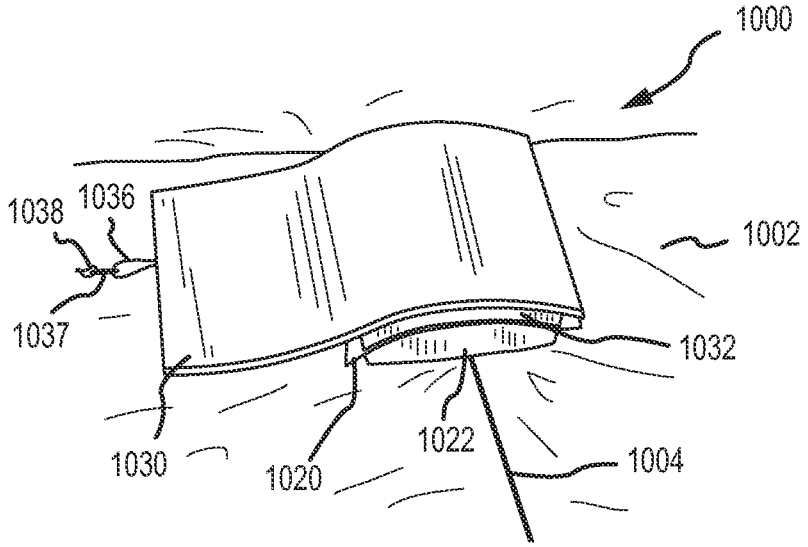
Figure 11D:
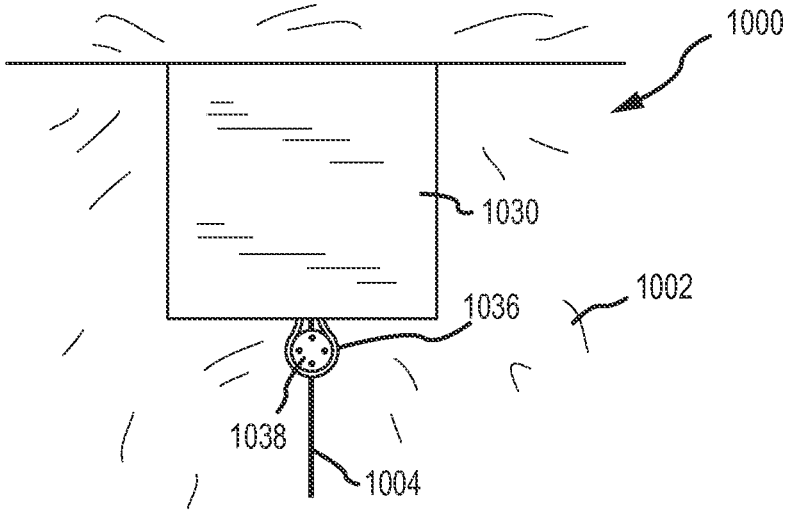

FIG. 11C illustrates an embodiment similar to that shown in FIG. 11B except that flap 1030 also includes a foam pad 1032 that presses against the outer surface of flap 1020 when flap 1030 is coupled with fabric body 1002. FIG. 11D illustrates the cover 1000 of FIG. 10D being folded over zipper 1004. Specifically, FIG. 11D illustrates flap 1030 folded orthogonally over flap 1020 (not shown) in a direction aligned with zipper 1004 and coupled with fabric body 1002 to effectively seal the outer periphery of flap 1030 and thereby minimize bed bug access to the secured flap's interior. Flap 1070 of FIG. 10E may likewise be coupled with fabric body 1002. Flap 1030, and likewise flap 1070, may include the additional fastener 1036 that couples with an additional fastener 1038 of fabric body 1002 to reinforce the attachment of the flap.

Figure 12:
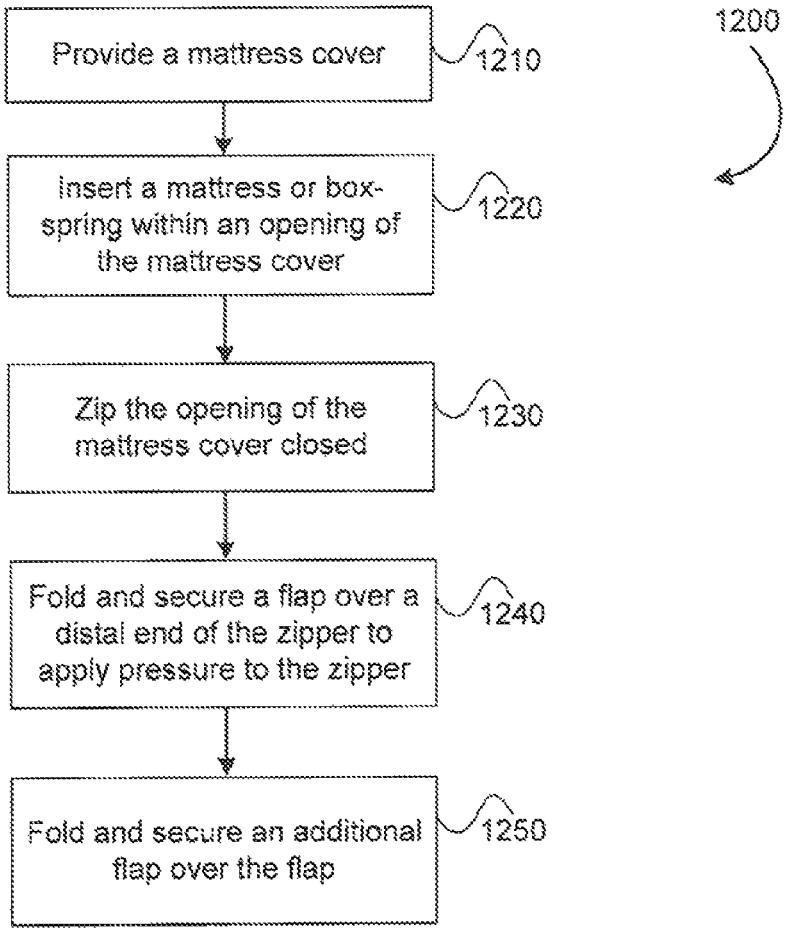
FIG. 12 illustrates a method for covering a bed component, such as a mattress or box-spring, with any of the various covers described herein.

Referring now to FIG. 12, illustrated is a method for covering a mattress or box-spring with a covering that discourages or prevents bed bugs from accessing the covered or enclosed mattress or box-spring. At block 1210, a mattress cover as described herein is provided. The mattress cover may include an opening that allows the mattress or box-spring to be inserted within an interior of the cover, a zipper coupled with the opening, a zipper mechanism slidable along the zipper to couple opposing teeth of the zipper to allow the opening to be zipped closed, a flap foldable and releasably securable over a distal end of the zipper to cover the zipper mechanism when the opening is zipped closed, and a barrier material (e.g., a foam pad) coupled with the flap for applying pressure to the zipper when the flap is secured over the distal end of the zipper. At block 1220, a mattress or box-spring is inserted within the opening of the mattress cover. At block 1230, the zipper mechanism is advanced distally along the zipper to zip the opening closed, thereby enclosing or encasing the mattress or box-spring within the mattress cover. At block 1240, the flap is folded and secured over the distal end of the zipper to apply pressure to the zipper via the secured flap and the barrier material.

At block 1250, the method may also include folding and securing a second or additional flap over the flap previously secured over the distal end of the zipper (i.e., a first flap) so as to cover, reinforce, and/or apply pressure to the first flap. In one embodiment, the first flap is foldable laterally over the distal end of the zipper and the second flap is foldable laterally over the first flap in a direction opposite the first flap. In another embodiment, the first flap is foldable laterally over the distal end of the zipper and the second flap is foldable longitudinally along the zipper over the first flap. In some embodiments, the method may further include securing three edges of the second or additional flap to the cover so that the entire outer periphery of the second flap is substantially secured to the cover as previously described.

The zipper mechanism may be distally advanced along the zipper until a distal end of the zipper mechanism contacts a distal stop that limits distal advancement of the zipper mechanism. In some embodiments, the distal stop includes stitching that is positioned laterally across the zipper.

The material(s) used for the covers described herein may be of sufficient thread count to prevent a bed bug from accessing the mattress through the material. The fabric of the cover may be a dust mite resistant fabric, such as velour, terry or terry cloth, vinyl, and the like. Likewise, the stitching of the covers described herein may have sufficiently small spacing to prevent a bed bug from crawling through or between the stitches.

As previously described, the term "mattress" as used herein may include bed bases (e.g., box-springs), mattresses placed on bed bases, and/or any other type of bedding. In some embodiments, the cover may be customized depending on the mattress it is to cover. For example, when covering a traditional mattress on which an individual rests or sleeps, a top portion of the cover may include a soft material that cushions the individual or otherwise provides comfort. In contrast, when covering a bed base or box-spring, the cover need not include such soft materials.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A covering for a mattress or box-spring comprising:

a cover having an opening that provides access to an interior of the cover, the opening allowing a mattress or box-spring to be inserted within the interior;

a zipper coupled along the opening;

a zipper mechanism slidable along the zipper to couple opposing teeth of the zipper to allow the opening to be zipped closed to encase the mattress or box-spring within the cover;

a first flap positioned on one side of the zipper and foldable longitudinally over a distal end of the zipper in a first direction to cover the zipper mechanism when the opening is zipped closed;

a first fastener configured to releasably secure the first flap over the distal end of the zipper;

a second flap positioned on an opposite side of the zipper and foldable laterally over the first flap in a second direction opposite the first direction so as to cover the first flap; and a second fastener configured to releasably secure the second flap over the first flap;

wherein the first flap includes a barrier material for applying pressure to the zipper to minimize a gap between the zipper and the first flap.

2. The covering of claim 1, wherein the cover further comprises an additional barrier material coupled with the second flap.

3. The covering of claim 1, wherein the second flap does not include a barrier material.

4. The covering of claim 1, wherein the barrier material comprises a foam material.

5. The covering of claim 1, further comprising a third flap that folds longitudinally over the first and second flaps in a third direction substantially orthogonal to the first and second directions.

6. The covering of claim 1, further comprising a third fastener configured to releasably secure the second flap over the first flap.

7. The covering of claim 1, further comprising stitching extending laterally across the zipper near a distal end of the zipper that limits distal advancement of the zipper mechanism along the zipper by directly contacting the zipper mechanism.

8. The covering of claim 1, wherein the barrier material comprises an insect repellant additive.

9. A mattress or box-spring encasement comprising:

a cover having an opening to allow a mattress or box-spring to be inserted within an interior of the cover;

a zipper coupled with the opening;

a zipper mechanism slidable along the zipper to couple opposing teeth of the zipper to allow the opening to be zipped closed to enclose the mattress or box-spring within the cover;

a first flap foldable and securable over a distal end of the zipper to cover the zipper mechanism when the opening is zipped closed;

a barrier material coupled with the first flap such that when the flap is secured over the distal end of the zipper, pressure is applied to the zipper; and a second flap foldable and securable over the first flap such that when secured, the second flap extends fully around the first flap.

10. The mattress or box-spring encasement of claim 9, wherein the second flap includes a fastener that secures the second flap over the first flap such that when secured, the fastener extends fully around the first flap.

11. The mattress or box-spring encasement of claim 9, further comprising an additional barrier material coupled with the second flap such that when the second flap is secured over the first flap, pressure is applied to the first flap.

12. A method for covering a mattress or box-spring comprising:

providing a mattress cover including:

an opening that allows the mattress or box-spring to be inserted within an interior of the cover;

a zipper coupled with the opening;

a zipper mechanism slidable along the zipper to couple opposing teeth of the zipper to allow the opening to be zipped closed;

a first flap foldable and releasably securable over a distal end of the zipper to cover the zipper mechanism when the opening is zipped closed;

a barrier material coupled with the first flap for applying pressure to the zipper when the first flap is secured over the distal end of the zipper; and a second flap foldable and securable over the first flap such that when secured, the first flap is fully enclosed by the second flap;

inserting the mattress or box-spring within the opening of the mattress cover;

advancing the zipper mechanism distally along the zipper to zip the opening closed;

folding and securing the first flap over the distal end of the zipper to apply pressure to the zipper; and folding and securing the second flap over the first flap so that the first flap is fully enclosed by the second flap.

13. The method of claim 12, further comprising folding and securing a third flap over the first flap to cover the first flap, the second flap being foldable and securable over the first flap and the third flap to fully enclose the first flap and the third flap.

14. The method of claim 13, wherein the first flap is foldable laterally over the distal end of the zipper and wherein the second flap is foldable longitudinally along the zipper.

15. The method of claim 14, wherein the method further comprises securing three edges of the second flap to the cover so that the outer periphery of the second flap is substantially secured to the cover.

16. The method of claim 12, wherein the zipper mechanism is distally advanced along the zipper until a distal end of the zipper mechanism directly contacts stitching that is positioned laterally across the zipper, wherein the stitching limits distal advancement of the zipper mechanism.

17. The method of claim 12, wherein the zipper mechanism is distally advanced along the zipper until a distal end of the zipper mechanism directly contacts a fabric tab that is positioned laterally across the zipper, wherein the fabric tab limits distal advancement of the zipper mechanism.

* * * * *